US011626265B2

(12) United States Patent
Mittelstadt

(10) Patent No.: US 11,626,265 B2
(45) Date of Patent: Apr. 11, 2023

(54) BI-STABLE TRIP UNIT WITH TRIP SOLENOID AND FLUX TRANSFER RESET

(71) Applicant: Schneider Electric USA, Inc., Andover, MA (US)

(72) Inventor: Chad R. Mittelstadt, Cedar Rapids, IA (US)

(73) Assignee: Schneider Electric USA, Inc., Boston, MA (US)

( * ) Notice: Subject to any disclaimer, the term of this patent is extended or adjusted under 35 U.S.C. 154(b) by 111 days.

(21) Appl. No.: 17/418,070

(22) PCT Filed: Dec. 26, 2019

(86) PCT No.: PCT/US2019/068560
§ 371 (c)(1),
(2) Date: Jun. 24, 2021

(87) PCT Pub. No.: WO2020/139933
PCT Pub. Date: Jul. 2, 2020

(65) Prior Publication Data

US 2022/0076912 A1 Mar. 10, 2022

Related U.S. Application Data

(60) Provisional application No. 62/785,902, filed on Dec. 28, 2018.

(51) Int. Cl.
*H01H 71/24* (2006.01)
*H01H 50/18* (2006.01)
(Continued)

(52) U.S. Cl.
CPC ..... *H01H 71/24* (2013.01); *H01H 50/18* (2013.01); *H01H 50/36* (2013.01); *H01H 71/66* (2013.01)

(58) Field of Classification Search
CPC ..... H01H 71/66; H01H 71/24
(Continued)

(56) References Cited

U.S. PATENT DOCUMENTS 3,098,136 A 7/1963 Stanback et al.
4,604,596 A * 8/1986 Yokoyama ..... H01H 89/10 335/14

(Continued)

OTHER PUBLICATIONS

International Search Report and Written Opinion dated Apr. 2, 2020 for PCT/US2019/068560, 15 pages.

*Primary Examiner* — Alexander Talpalatski
(74) *Attorney, Agent, or Firm* — Locke Lord LLP

(57) ABSTRACT

A trip unit for a circuit breaker includes a magnetic flux transfer system that employs a permanent magnet(s) and solenoid(s) with a ferromagnetic core. The system generates an attractive force using a solenoid to counter the force of a reset spring and latch friction force when a tripping condition is detected. The generated attractive force together with an attractive force from the magnet attracts a yoke which in turn moves the yoke together with an armature to the tripped position. The system also retains the yoke and armature in the tripped position using the attractive force of the magnet when the generated attractive force is no longer being generated. The system further generates a repulsive force using a solenoid when a resettable condition is satisfied to counter the attractive force of the magnet thereby allowing the yoke and armature to move from the tripped position to the reset position.

16 Claims, 14 Drawing Sheets

(51) Int. Cl.
*H01H 50/36* (2006.01)
*H01H 71/66* (2006.01)

(58) Field of Classification Search
USPC ..... 335/174
See application file for complete search history.

(56) References Cited

U.S. PATENT DOCUMENTS

| | | | | |
|---|---|---|---|---|
| 4,623,859 | A | 11/1986 | Erickson et al. | |
| 5,481,235 | A * | 1/1996 | Heise | H01H 83/04 361/42 |
| 9,048,054 | B2 * | 6/2015 | Potratz | H01H 9/20 |
| 2010/0156576 | A1 | 6/2010 | Broghammer et al. | |
| 2012/0132506 | A1 | 5/2012 | Potratz | |
| 2014/0176293 | A1 * | 6/2014 | Melecio | H01H 71/18 337/12 |

* cited by examiner

BI-STABLE TRIP UNIT WITH TRIP SOLENOID AND FLUX TRANSFER RESET

The present application claims priority to U.S. Provisional Application Ser. No. 62/785,902, entitled BI-STABLE TRIP UNIT WITH TRIP SOLENOID AND FLUX TRANSFER RESET, which was filed on Dec. 28, 2018 and is incorporated herewith in its entirety.

TECHNICAL FIELD

The present disclosure relates generally to a trip unit for a circuit protective device, and more particularly, an improved trip unit with a solenoid and permanent magnet.

BACKGROUND

A circuit breaker is a protective device that is used for circuit protection and isolation on a power system. The circuit breaker provides electrical system protection when a designated electrical abnormality or fault condition such as an overcurrent, short circuit or overload event or other abnormal event occurs in the system. One type of circuit breaker is a miniature circuit breaker (MCB), which can be for low voltage applications. An MCB can include a base and cover, and an electrical circuit between a line terminal and a load terminal. The electrical circuit can include a conductive stationary contact electrically connected to one of the terminals and a movable contact electrically connected to the other terminal. The movable contact is secured on a movable blade (also referred to as a contact carrier). A handle interfaces with the blade and the trip lever of the trip unit/mechanism as further explained below. The handle can be operated by a user to move the blade, and thus the movable contact, between an open position and a closed position to open or close the electrical circuit. In the closed position, the movable contact is engaged with the stationary contact to allow current flow between the two contacts to a protected load. In the open position, the movable contact is disengaged from the stationary contact to prevent or interrupt current flow to the protected load.

The MCB also includes a trip unit. The trip unit controls a trip lever, which is connected to the blade via a tension spring (also known as a "toggle spring"). When an abnormal operating or fault condition is detected (e.g., an over current or over temperature fault), the trip unit implements a tripping operation to disengage the movable contact from the stationary contact by unlatching the trip lever, which in turn interrupts current flow to the protected load at a tripped position. Thereafter, the circuit breaker can be placed in a RESET position to re-latch the trip lever, which returns the circuit breaker to an open position. Once in the open position, the user can move the breaker back to the closed position via the handle to turn the circuit breaker ON.

SUMMARY

In accordance with various embodiments, systems and methods are provided to control tripping and releasing operations in a circuit protective device, such as a circuit breaker, using a permanent magnet and one or more solenoids with a ferromagnetic core. The circuit breaker can be a miniature circuit breaker.

In accordance with an embodiment, a trip unit for a circuit protective device and a method of operation thereof is provided. The trip unit can include a movable armature and yoke, a reset spring, and a magnetic flux transfer system. The movable armature has a front side, a back side and an opening extending from the front side to the back side. The opening is configured to receive a portion of a trip lever of the circuit protective device from the front side when in an ON, OFF or Reset position. The movable yoke is arranged adjacent to the back side of the armature. The yoke and armature are configured to move together to different positions including a reset position and a tripped position. The reset position is a position in which the portion of the trip lever is resettable into the opening of the armature (e.g., the trip lever can be latched to the armature via the opening). The tripped position is a position in which the trip lever is released from the opening of the armature and is unable to be reset into the opening of the armature. The reset spring is configured to apply a force that biases the armature toward the reset position.

The magnetic flux transfer system includes a permanent magnet and one or more solenoids each with a ferromagnetic core. The magnetic flux transfer system is configured: (1) to generate an attractive (or attracting) force using a solenoid from the one or more solenoids to counter the force of the reset spring and latch friction force when a tripping condition is detected, the generated attractive force together with an attractive force from the permanent magnet attracting the yoke which in turn moves the yoke together with the armature to the tripped position; (2) to retain the yoke and armature in the tripped position using the attractive force of the permanent magnet when the generated attractive force is no longer being generated; and (3) to generate a repulsive (or repelling) force using a solenoid from the one or more solenoids when a resettable condition is satisfied, the generated repulsive force together with the force of the reset spring countering the attractive force of the permanent magnet thereby releasing the yoke and armature from the tripped position and allowing the yoke and armature to move or return to the reset position.

A solenoid from the one or more solenoids can be configured to produce the attractive and repulsive forces by changing a polarity of current supplied thereto under different conditions including the tripping condition and the resettable condition. The ferromagnetic core of the solenoid can include a first end which faces a direction of the yolk and a second end which is in contact with or proximity to the permanent magnet. In the tripped position, the yoke can be in contact with the first end of the ferromagnetic core.

The trip unit can include a trip actuator and a reset actuator. The trip actuator can include a first solenoid from the one or more solenoids. The reset actuator can include a second solenoid from the one or more solenoids and the permanent magnet which is in contact with or proximity to a ferromagnetic core of the second solenoid. The first solenoid can be energized to generate an attractive force. The second solenoid can be energized to generate a repulsive force. For example, the first solenoid can be energized by a first current having either a positive or negative polarity for generating attractive force. The second solenoid can be energized using a second current having only one direction of current that neutralizes the permanent magnet. The direction of current for the second solenoid can depend on its design, such as winding of coil direction and permanent magnet pole orientation.

In accordance with an embodiment, a circuit protective device can include the trip unit along with a stationary electrical contact, a blade carrying a movable electrical contact, a memory, and one or more processors. The blade with the movable electrical contact is configured to move between a first position and a second position. The first position is a position in which the movable electrical contact is in contact with the stationary electrical contact to allow current to flow thereacross in an ON position. The second position is a position in which the movable electrical contact is separated from the stationary electrical contact in one of a tripped position, open position or reset position. The one or more processors are configured to control the trip unit to operate to the tripped position when a tripped condition is detected thereby causing the blade to move to the second position, and to operate to the reset position from the tripped position when the resettable condition is satisfied. In the tripped position, the trip lever is released from the opening of the armature which in turn causes the movable electrical contact to separate from the stationary electrical contact. In the reset position, the trip lever is operable to an open position, which latches the portion of the trip lever into the armature opening. In this way, the circuit protective device can be operated afterwards to an ON position.

Additional objects and advantages will be set forth in part in the description which follows, and in part will be obvious from the description, or may be learned by practice of the present disclosure and/or claims. At least some of these objects and advantages may be realized and attained by the elements and combinations particularly pointed out in the appended claims. It is to be understood that both the foregoing general description and the following detailed description are exemplary and explanatory only and are not restrictive of the invention, as disclosed or claimed. The claims should be entitled to their full breadth of scope, including equivalents.

BRIEF DESCRIPTION OF THE DRAWINGS

These accompanying drawings are not intended to be drawn to scale. In the drawings, each identical or nearly identical component that is illustrated with various figures, are represented by a line numeral. For purposes of clarity, not every component may be labeled in every drawing. In the drawings.

DETAILED DESCRIPTION

This description and the accompanying drawings illustrate exemplary embodiments and should not be taken as limiting, with the claims defining the scope of the present disclosure, including equivalents. Various mechanical, compositional, structural, electrical, and operational changes may be made without departing from the scope of this description and the claims, including equivalents. In some instances, well known structures and techniques have not been shown or described in detail so as not to obscure the disclosure. Like numbers in two or more figures represent the same or similar elements. Furthermore, elements and their associated aspects that are described in detail with reference to one embodiment may, whenever practical, be included in other embodiments in which they are not specifically shown or described. For example, if an element is described in detail with reference to one embodiment and is not described with reference to a second embodiment, the element may nevertheless be claimed as included in the second embodiment.

It is noted that, as used in this specification and the appended claims, the singular forms "a," "an," and "the," and any singular use of any word, include plural referents unless expressly and unequivocally limited to one referent. As used herein, the term "include" and its grammatical variants are intended to be non-limiting, such that recitation of items in a list is not to the exclusion of other like items that can be substituted or added to the listed items.

Systems and methods for operating a circuit protective device, such as a circuit breaker or interrupter, are provided to control tripping, retaining, and releasing operations and the conditions under which the circuit protective device and its components can be tripped to a tripped position, retained in the tripped position, and released from the tripped position to a reset position through a simple, cost-effective design using one or more solenoids with a ferromagnetic core and a permanent magnet. The ferromagnetic components of the circuit protective device can be made from steel or other materials having a high susceptibility to magnetization. Examples of these and other features of the systems and methods are shown and described with reference to the examples in FIGS. 1-11.

Figure 1:
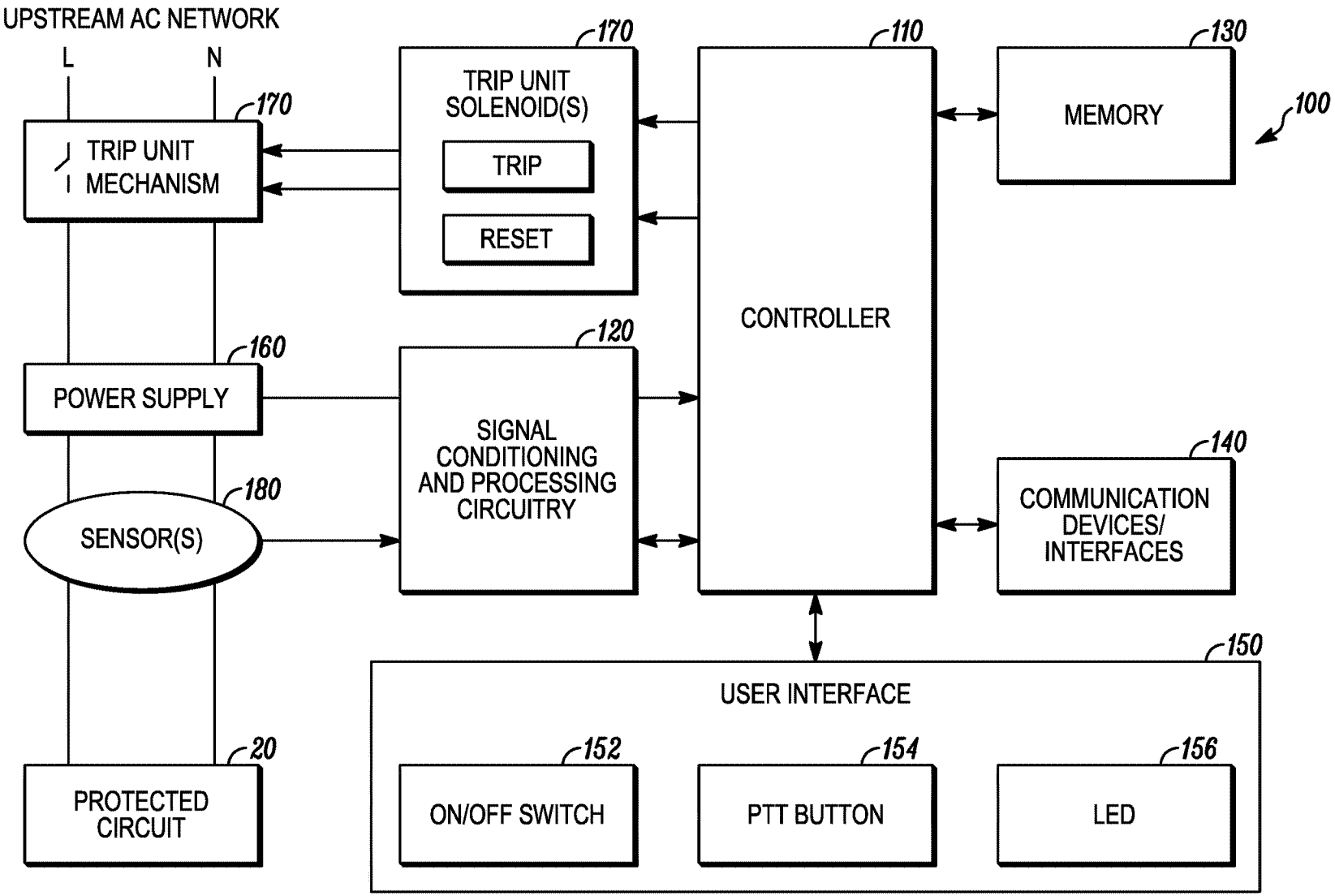
FIG. 1 illustrates block diagram of a circuit with a circuit breaker which employs a bi-stable trip unit with a magnetic flux transfer system having one or more actuators for performing and controlling tripping and releasing operations using a combination of solenoid(s) and permanent magnet(s) in accordance with an embodiment of the present disclosure.

FIG. 1 illustrates a block diagram of an example circuit protective device, such as a circuit breaker 100 with a flux-based trip unit (or system), to monitor and protect circuit 20 (e.g., a branch circuit) on an AC power line 10. The circuit breaker 100 includes a controller 110, signal conditioning and processing circuitry 120 to receive and process signals from a current sensor 180, a memory 130, communication devices/interfaces 140 to communicate with remote devices over a communication medium, a user interface 150, a power supply 160 to power the components of the circuit breaker 100, and a trip unit/mechanism 170 to interrupt power on the power line 10 upstream of the protected circuit 20. The user interface 150 can include an ON/OFF switch 152 (e.g., a handle), a push-to-test (PTT) button 154 to test the circuit breaker 100, and one or more LEDs 156 or other indicators for indicating a status and/or position of the circuit breaker or its components (e.g., ON/CLOSED, OFF/OPEN, RESET, TRIPPED, ABNORMAL, etc.) or other circuit breaker information.

In the circuit breaker 100, the sensor 180, the circuitry 120, the controller 110 and memory 130 can operate together to provide a detection system, which is configured to detect a tripping condition such as a fault (e.g., arc fault) or other conditions for tripping the circuit breaker. For example, the controller 110 can monitor current, voltage, power or other electrical property on the power line of a power system via the sensor(s) 180, and detect a presence or absence of a tripping condition, such as an arc fault condition, ground fault condition, overload condition or other conditions under which current (or power) is to be interrupted on the circuit 20. The controller 110 is also configured to initiate a tripping operation, which interrupts power on the power line 10 via the trip unit 170 when the presence of a tripping condition is detected. For example, the trip unit 170 can separate electrical contacts (e.g., a stationary electrical contact and a movable electrical contact) of the circuit breaker 100 to interrupt current flow in response to a tripping condition. The tripping operation can move or enable movement of components of the circuit breaker 100 to a tripped position, and the releasing operation can move or enable movement of components of the circuit breaker to a resettable position or the like. The controller 110 is also configured to initiate a release operation which allows the components of the circuit breaker 100 to return or move to the resettable position, when a resettable condition is satisfied. From the reset position, the circuit breaker 100 can for example be operated to an OPEN position (e.g., trip lever is latched to armature) and then an ON position (e.g., closing the electrical contacts). The resettable condition can include satisfying/passing diagnostic tests, such as a self-check or other diagnostic tests on the circuit breaker or the power system, to ensure that the circuit breaker or its components are operating within a normal range or the supply of current can be safely resumed on the circuit 20. The controller 110 can perform such diagnostic tests locally or in combination with a remote computer management system, which monitors the power system and its components.

The controller 110 is also configured to control other operations of the circuit breaker 100 including but not limited to communication via the communication interfaces 140 (e.g., to receive or transmit commands or status information/reports), to perform operations based on actions input by a user through the user interface 150, to output a status of the circuit breaker 100 such as via the LED 156 or other output device, and to perform other operations of the circuit breaker 100 shown and described herein.

The memory 130 can store computer executable code or programs or software, which when executed by the controller 110, controls the operations of the circuit breaker 100 including the detection of a tripping condition and a resettable condition, the control of the tripping operation and the releasing operation, and the other operations of the circuit breaker 100. The memory 130 can also store other data used by the circuit breaker 100 or components thereof to perform the operations described herein. The other data can include but is not limited to threshold conditions, circuit breaker operating parameters, other circuit breaker data, and any other data discussed herein.

The trip unit 170 includes a magnetic flux transfer system with at least one or more actuators, which can employ a solenoid(s) around a ferromagnetic core(s) and a permanent magnet(s), for implementing tripping, retaining, and releasing operations, as described herein. Examples of the trip unit 170 will be described in further detail below.

Figure 2:
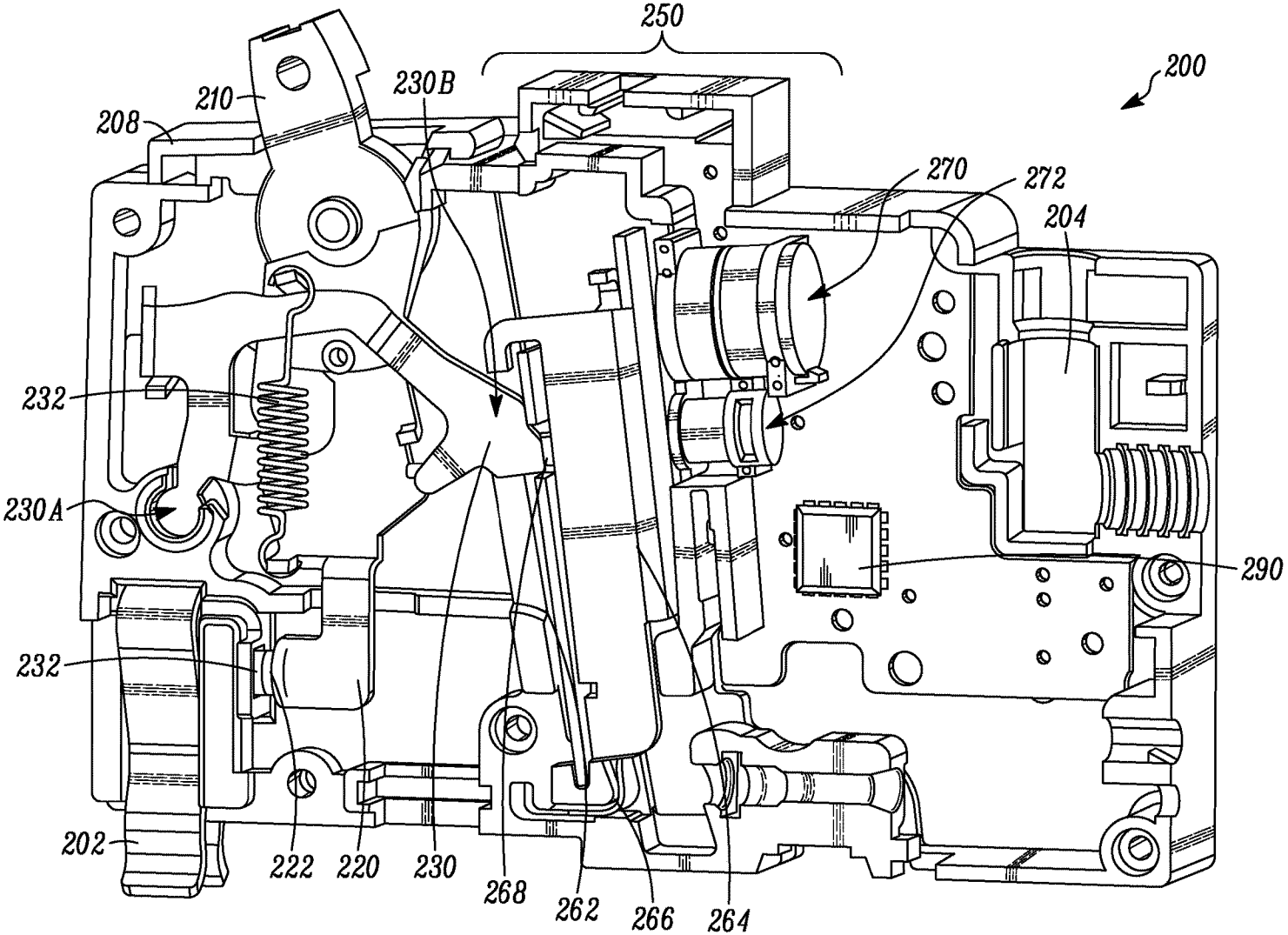
FIG. 2 illustrates of components of a circuit breaker, such as for example in FIG. 1, with a portion of the housing (or enclosure) removed to show a trip unit with a trip actuator and a reset actuator in accordance with an embodiment of the present disclosure.
Figure 3:
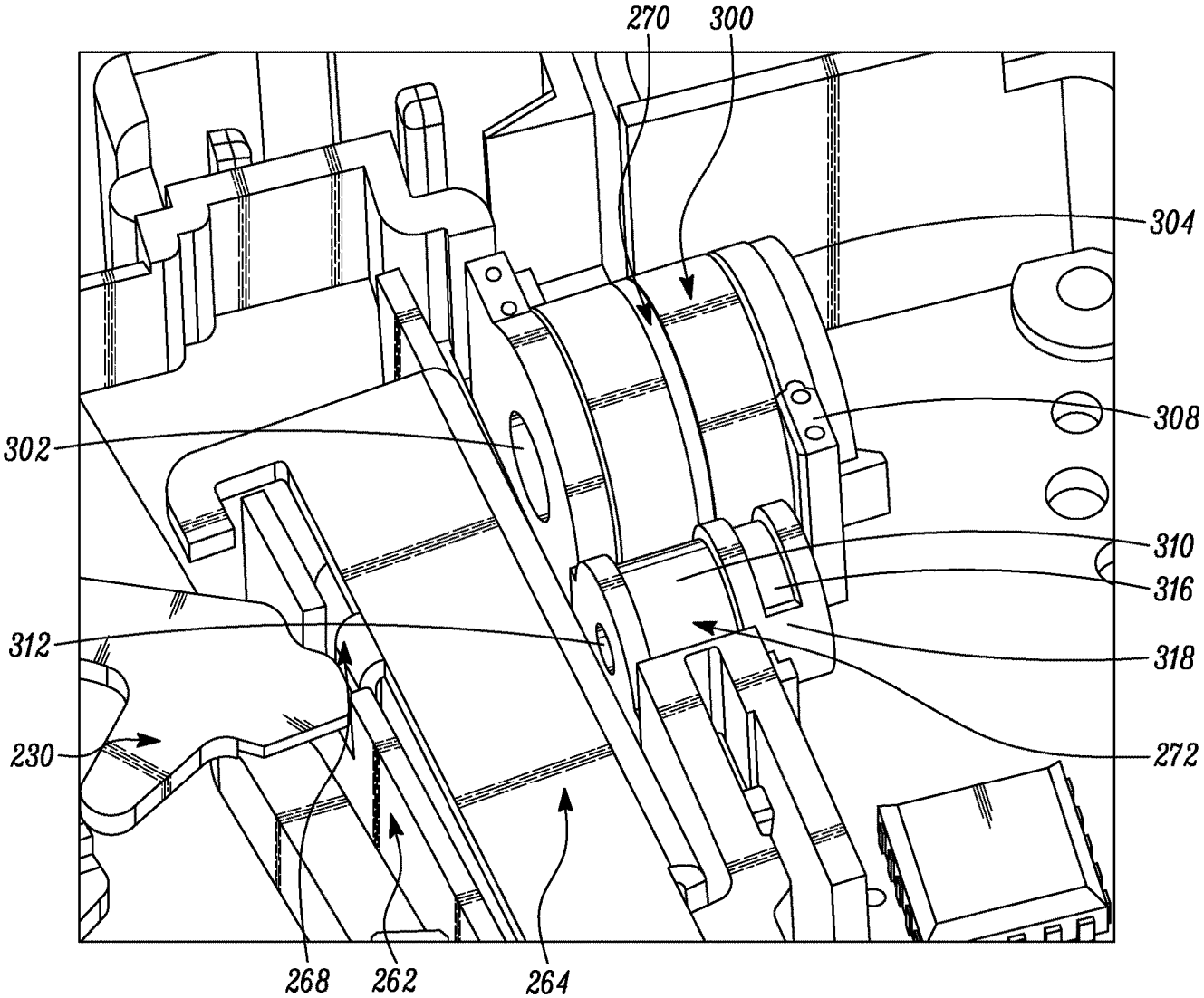
FIG. 3 illustrates an enlarged view of a trip actuator and a reset actuator of a trip unit of the circuit breaker of FIG. 2.
Figure 4:
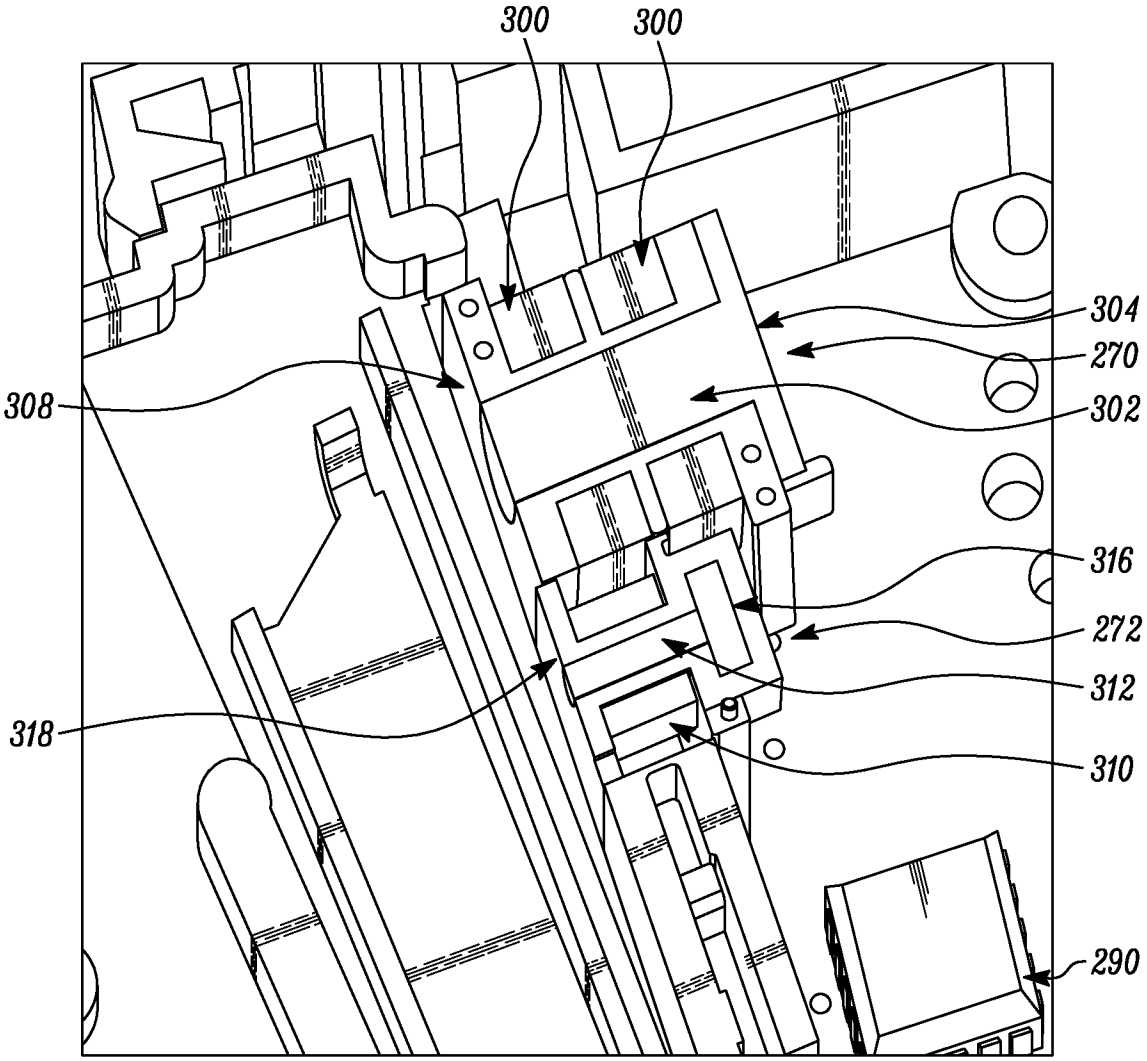
FIG. 4 illustrates a cross-sectional view of the trip and reset actuators of the trip unit in FIG. 3 in accordance with an embodiment of the present disclosure.

FIG. 2 illustrates a side view of an example circuit breaker, such as the circuit breaker 100 in FIG. 1, in accordance with one embodiment. In this example, the circuit breaker is a miniature circuit breaker (MCB) 200, with one side of its cover removed to show some of the components thereof. As shown in FIG. 2, the circuit breaker 200 includes a cover and base (together referred to as cover 208) having compartments and recesses for retaining components of the breaker. The components of the circuit breaker 200 can include a movable handle 210 connected to a conductive blade 220 carrying a movable electrical contact 222, a first terminal 202 connected to a stationary electrical contact 232, a second terminal 204 electrically connected to the blade 220 via conductor(s) (not shown), and a controller 290. The first terminal 202 can be a line terminal connected to a power line, and the second terminal 204 can be a load terminal connected to a protected load on a branch circuit.

The handle 210 of the circuit breaker 200 is connected to the blade 220 to give the operator the ability to turn the circuit breaker 200 ON (in the closed position) to energize a protected circuit or OFF (in the open position) to disconnect the protected circuit, or to reset the circuit breaker 200 from a tripped position after it trips to protect the circuit. In this example, the handle 210 is pivotably connected via mechanical fastener(s) to the blade 220, but may be movably connected through other types of connections (e.g., a wedge connection such as a tab and slot, a tab and notch, etc.). The handle 210 can be operated to move the blade 220 between the open position to disengage the electrical contacts 222 and 232 from each other and the closed position to engage the electrical contacts 222 and 232.

The circuit breaker 200 further includes a trip unit or assembly 250 (referred herein as "trip unit") which, when tripped, causes the blade 220 to move from the closed position to the tripped position, in the event of an anomalous thermal or magnetic condition, hereinafter known as an "overcurrent condition," such as due to a short circuit or overload (e.g., over heating). When the circuit breaker 200 is in the tripped position, the electrical contacts 222 and 232 are disengaged from each other in the open position. The trip unit 250 of the circuit breaker 200 includes a trip lever 230, a toggle spring 232, an armature 262, a yoke 264, a reset spring 266 and one or more flux-actuators for implementing tripping, retaining and releasing operations using electromagnetic force(s) from solenoid(s) around a ferromagnetic core(s) and magnetic force(s) from a permanent magnet(s). In this example, the trip unit 250 includes two actuators, such as a trip actuator 270 and a reset actuator 272.

As further shown in FIG. 2, the toggle spring 232 is connected between the blade 220 and the trip lever 230. The trip lever 230 has a first end 230A and an opposite second end 230B, and is able to pivot about the first end 230A which is situated in a recess of the cover 208. The armature 262 includes an opening 268 that extends from a front side to a back side. The armature 262 is able to pivot about one end, which is situated in a recess of the cover 208. The yoke 264 is arranged adjacent to the back side of the armature 262, and can include a tab that is arranged adjacent to the opening 238 of the armature 262. The reset spring 266 provides a biasing force, which biases the armature 262 and the yoke 264 toward the trip lever 230 (e.g., pivots in a counter-clockwise direction about an end or toward the left in the circuit breaker 200 in FIG. 2). When the circuit breaker 200 is in the closed position as shown in FIG. 2, the second end 230B of the trip lever 230 is latched in the opening 268 of the armature 262, with the yoke 264 being separated from the back side of the armature 262.

The trip actuator 270 can include a solenoid with a ferromagnetic core (e.g., an electromagnet), and the reset actuator 272 can include a solenoid with a ferromagnetic core as well as a permanent magnet. For example, as shown in greater detail in FIGS. 3 and 4, the trip actuator 270 includes a conductive coil(s) 300 around a ferromagnetic core 302, a ferromagnetic plate 304, and a housing 308 to house and/or support components of the trip actuator 270. In this example, the ferromagnetic core 302 can have a cylindrical-shape, the ferromagnetic plate 304 can have a disc-shape, and the housing 308 may be formed of an electrically insulating material (e.g., a dielectric material). One end of the ferromagnetic core 302 faces the yoke 264, and the other end of the ferromagnetic core 302 is in contact with the ferromagnetic plate 304. The reset actuator 272 includes a conductive coil(s) 310 around a ferromagnetic core 312, a permanent magnet 316 in contact with the ferromagnetic core 302, and a housing 318 to house and/or support the component of the reset actuator 272. In this example, the ferromagnetic core 312 can have a cylindrical-shape, and the housing 318 may be formed of an electrically insulating material (e.g., a dielectric material). One end of the ferromagnetic core 312 faces the yoke 264, and the other end of the ferromagnetic core 312 is in contact with the permanent magnet 316.

The trip actuator 270 is configured to generate an electromagnetic field by applying current in a direction or polarity (e.g., positive or negative polarity) though the solenoid's coil(s) 300 with ferromagnetic material (e.g. core 302 and plate 304), which in turn generates an attractive (or attracting) force to attract the components of the circuit breaker 200, such as the armature 262 and the yoke 264. The attractive force generated by the trip actuator 270 in combination with the attractive force from the magnetic field produced by the permanent magnet 316 (via the core 312) can be used to counter the mechanical force of the reset spring 266 and latch friction force, thereby causing the armature 262 and the yoke 264 to move together toward the actuators 270, 272 into the tripped position. In the tripped position, the trip lever 230 is unlatched from the opening 268 of the armature 262, which results in the separation of the electrical contacts 222 and 232. In the tripped position, the yoke 264 also can be retained against the ferromagnetic core 312 by the attractive force from the permanent magnet 316 (across the core 312) of the reset actuator 272.

The reset actuator 272 is configured to generate an electromagnetic field by applying current in a direction or polarity through the solenoid's coil(s) 310 with ferromagnetic material (e.g., core 312), which in turn generates a repulsive (or repelling) force to repel the components of the circuit breaker 200, such as the armature 262 and the yoke 264. For example, the reset actuator 272 can be energized using a current having only one direction of current that neutralizes the permanent magnet 316. The direction of current for the reset actuator 272 can depend on its design, such as winding of coil direction and permanent magnet pole orientation.

The repulsive force generated by the reset actuator 272 in combination with the biasing force of the reset spring 266 can be used to overcome the attractive force of the permanent magnet 318, thereby causing the armature 262 and the yoke 264 to move or return back to a position to allow the circuit breaker 200 to be reset or the like.

Figure 5B:
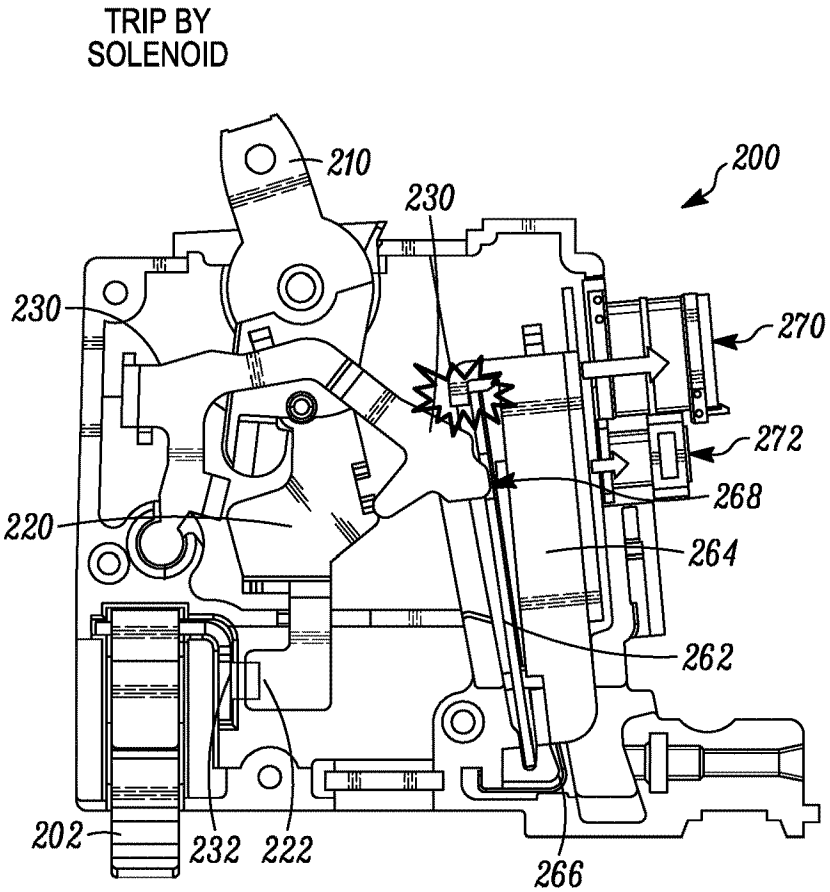
FIGS. 5A through 5H illustrate an operational example of the circuit breaker of FIG. 2 in accordance with an embodiment of the present disclosure.

An operational example of the circuit breaker 200 will be described with reference to FIGS. 5A through 5B. In this example, the trip actuator 270 and the reset actuator 272 are operated under control of the controller 290 (e.g., in FIG. 2).

Figure 5A:
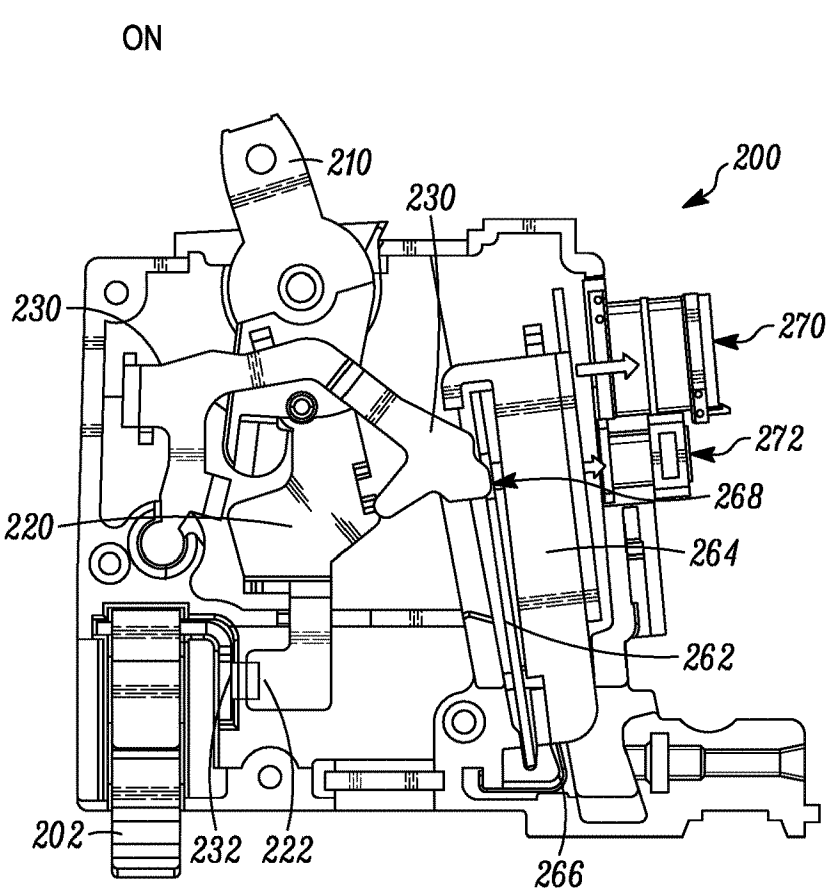

As shown in FIG. 5A, the circuit breaker 200 is initially in the closed (or ON) position, with one end of the trip lever 230 latched in the opening 268 of the armature 262. When a tripping condition is detected, the controller 290 can control the trip unit 250, via the trip actuator 270, to perform a tripping operation in the circuit protective device, which interrupts current to a protected circuit in response to detection of a tripping condition. For example, when a tripping condition is detected, the controller 290 can cause current to be applied to the solenoid (with ferromagnetic core) of the trip actuator 270 to generate an attractive force, as shown by an arrow. The attractive force from the trip actuator 270 in combination with the attractive force, also shown by an arrow, from the permanent magnet of the reset actuator 272 counteracts a force of the reset spring 266 (e.g., a leaf spring) and the latch friction force. As a result, the components of the circuit breaker 200, e.g., the armature 262 and the yoke 264, are moved to a tripped position as shown by the progression from FIG. 5A to FIG. 5B, thereby unlatching the trip lever 230 from the opening 268 of the armature 262 as shown in FIG. 5C which in turn separates the electrical contacts 222 and 232 of the circuit breaker 200 as shown in FIG. 5D.

Figure 5D:
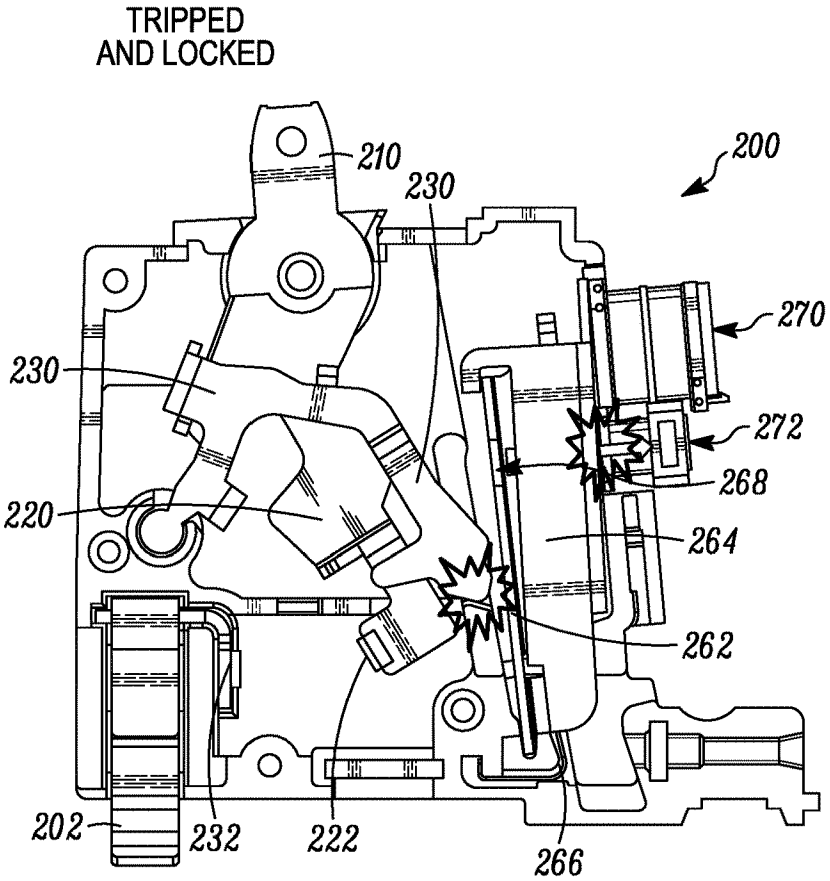
Figure 5C:
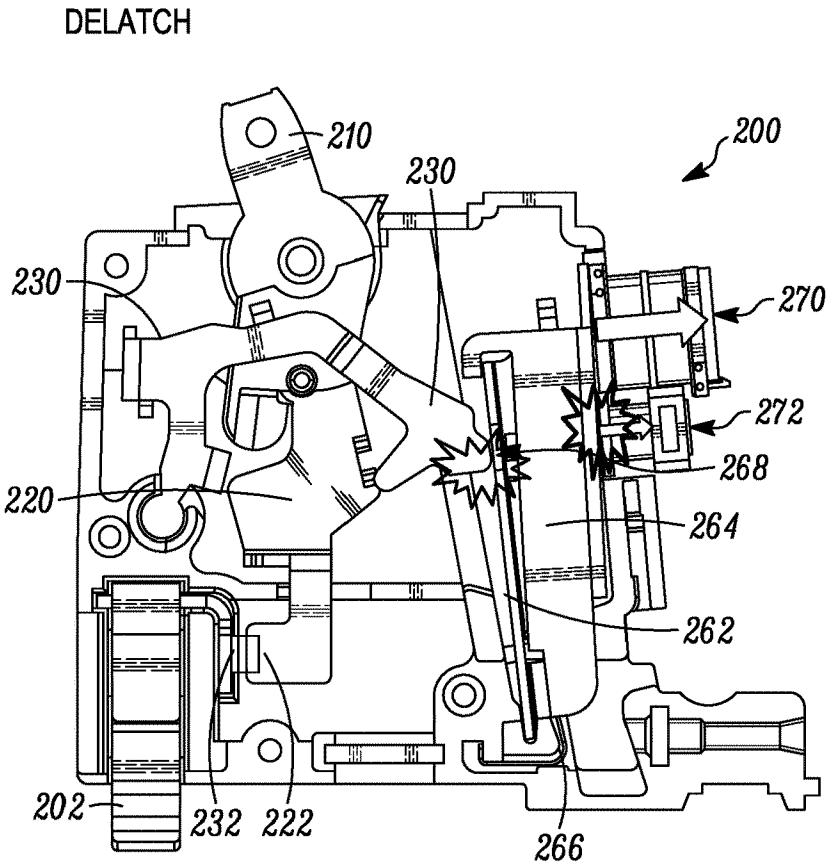
Figure 5F:
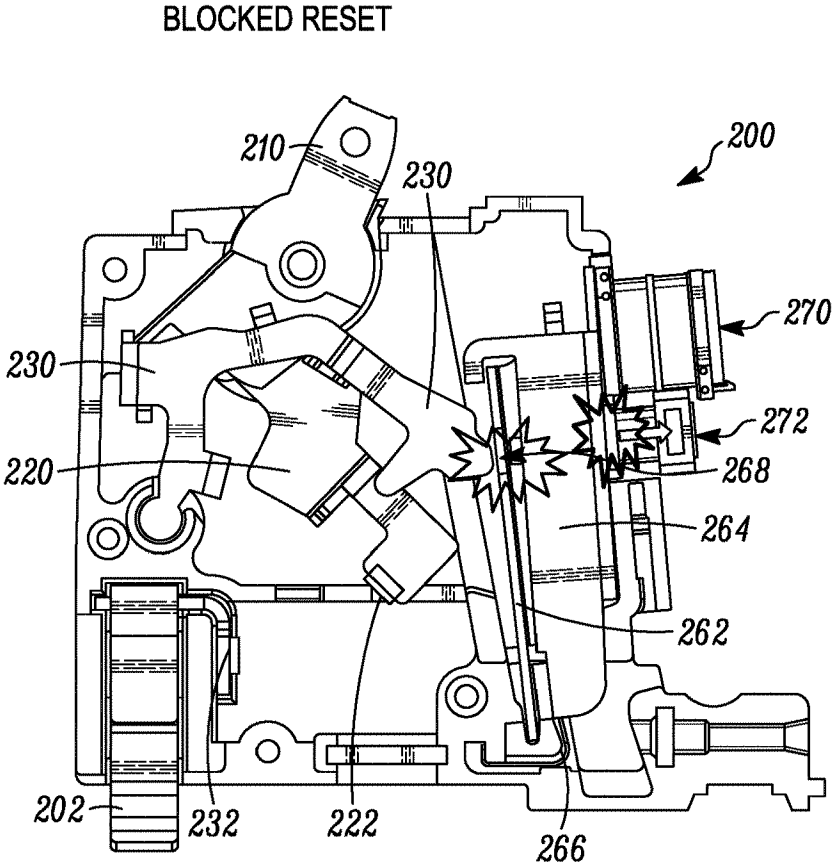
Figure 5E:
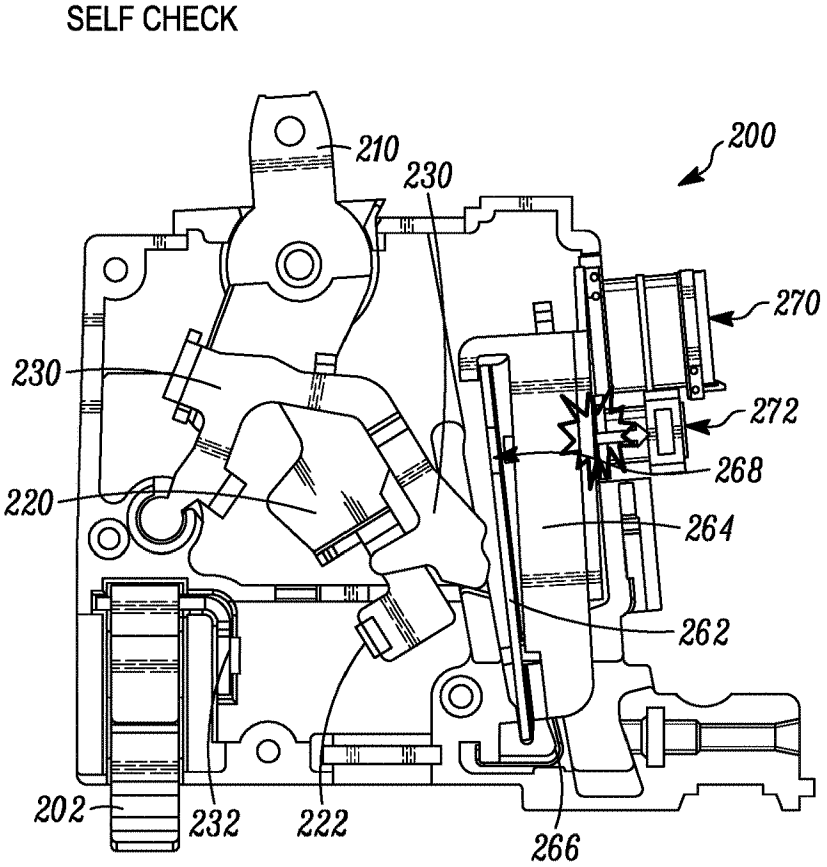

As further shown in FIG. 5D, in the tripped position, the yoke 264 is retained against the reset actuator 272. The attractive force of the permanent magnet of the reset actuator 272 (via the core 312) can retain the components of the circuit breaker 200 in the tripped position even when the attractive force from the trip actuator 270 is no longer being generated (e.g., no current flow through the solenoid of the trip actuator 270). As shown in FIG. 5E, while the components are retained, the circuit breaker 200 can perform a self-check, diagnostic test(s) or other evaluation related to the operation or components of the circuit breaker or the power system (e.g., normal or abnormal operational state) in order to determine whether to allow the circuit breaker 200 to return back to a reset (or resettable) position. As shown in FIG. 5F, in the tripped position, the components of the trip unit 250 are prevented from moving or returning to a reset (or resettable) position. For example, the trip lever 230 cannot be latched or re-latched into the opening 268 of the armature (even if moved towards the armature 262) while the circuit breaker 200 and its components are retained in the tripped position.

Figure 5H:
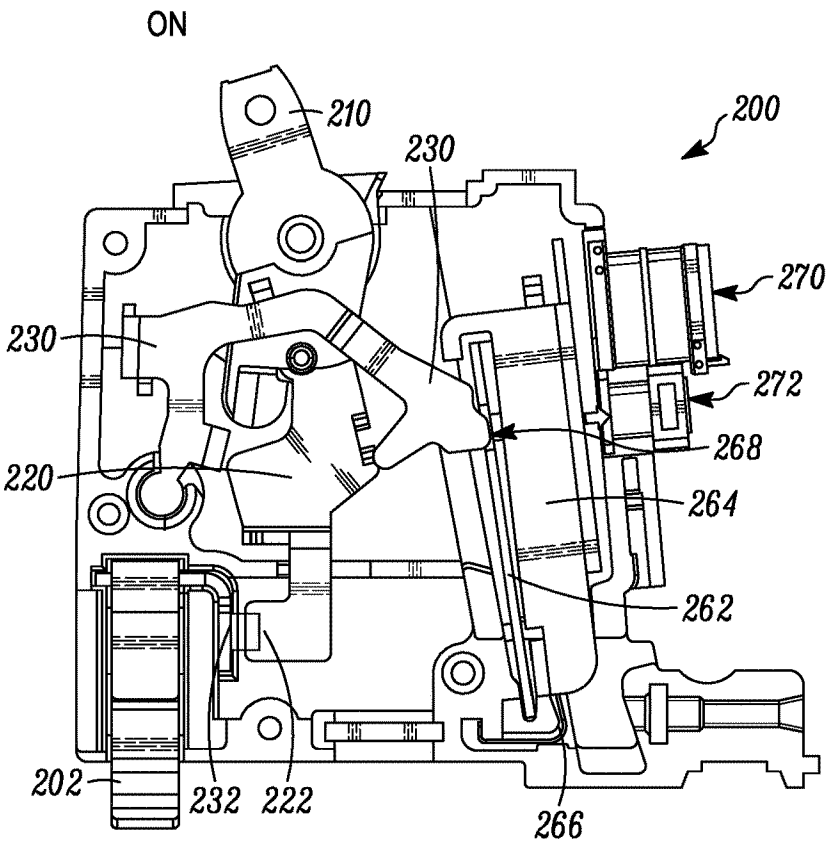
Figure 5G:
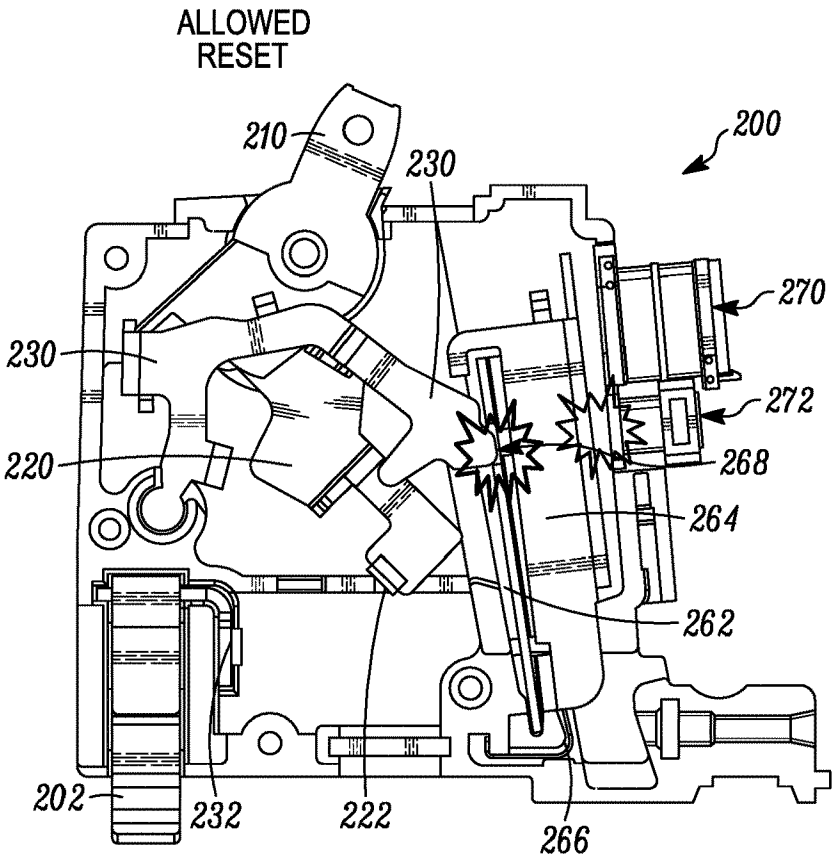

The controller 290 can be configured to release the components of the trip unit 250 from the tripped position, via the reset actuator 272, when a resettable condition is satisfied, e.g., a satisfaction of a self-check, a diagnostic test(s), or other evaluated conditions related to the operation or components of the circuit breaker or the power system (e.g., normal or abnormal operational state). For example, when the resettable condition is satisfied, the controller 290 can cause current to be applied to the solenoid in order to produce a repulsive force, which can counteract the attractive force of the permanent magnet 316 of the reset actuator 272, thereby releasing the components of the circuit breaker 200 from the tripped position and allowing the biasing force of the reset spring 266 to move or return them to a reset position as shown in FIG. 5G. Thereafter, the trip lever 230 can be re-latched to the armature 262 to place the circuit breaker 200 in an OFF or open position, from which the circuit breaker 200 can be operated afterwards to an ON or closed position where the electrical contacts 222 and 232 are in contact with each other as shown in FIG. 5H.

In the example described above, two separate actuators, e.g., trip actuator 270 and reset actuator 272, are employed in the trip unit 250; however, any number and combination of actuators can be employed in the trip unit 250 to perform the trip and release operations. For example, a single actuator with a permanent magnet and a solenoid with a ferromagnetic core can be controlled to selectively perform the trip and release operations under certain conditions, such as described below with reference to the examples in FIGS. 6, 7, 8A and 8B.

Figure 6:
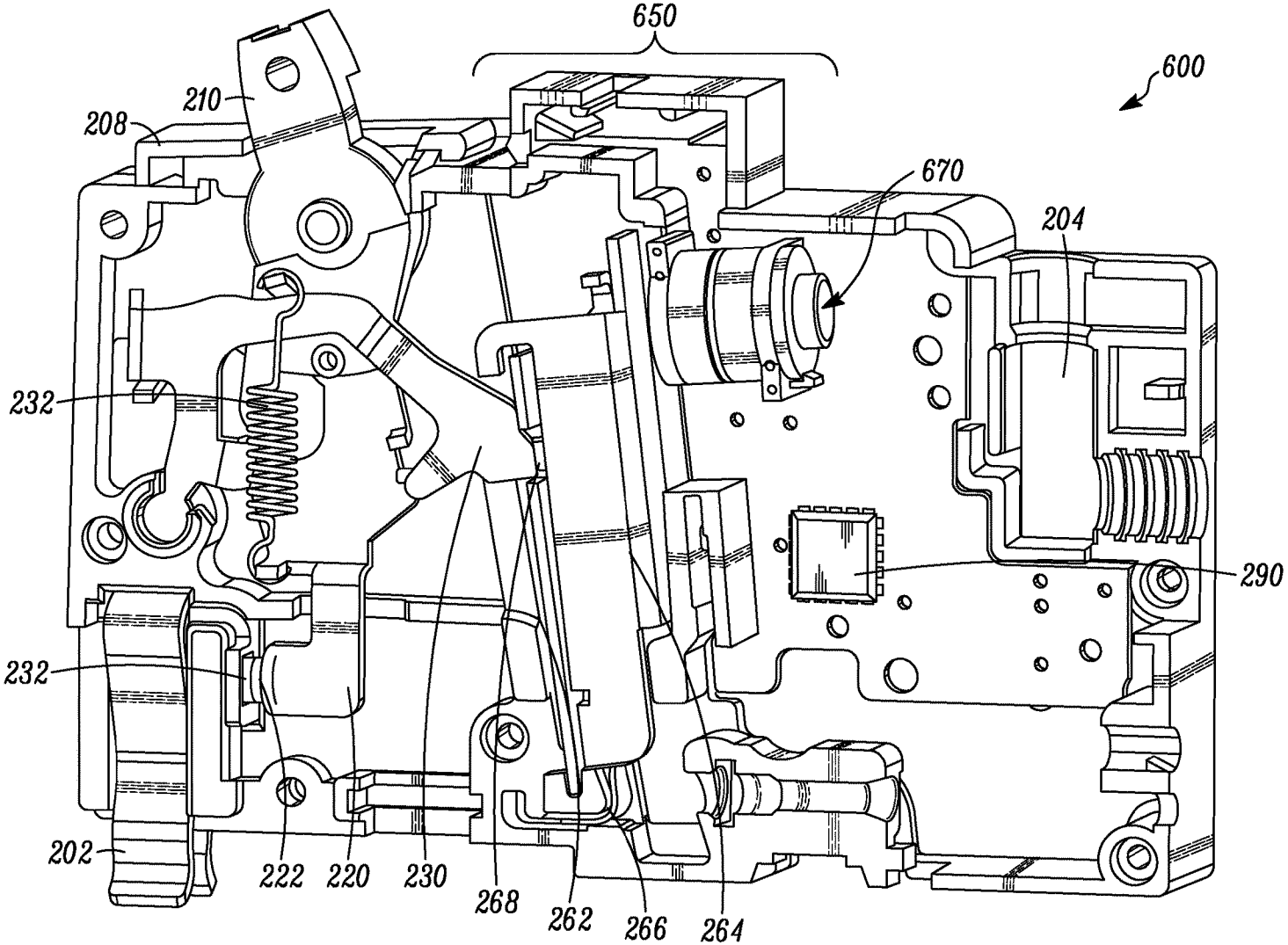
FIG. 6 illustrates a view of components of a circuit breaker, such as for example in FIG. 1, with a portion of the housing (or enclosure) removed in accordance with another embodiment of the present disclosure.

FIG. 6 illustrates a view of components of a circuit breaker, such as for example in FIG. 1, with a portion of the housing (or enclosure) removed in accordance with another embodiment of the present disclosure. In this example, the circuit breaker 600 can include similar components and operate in a similar fashion as the circuit breaker 200 in FIG. 2, except that the circuit breaker 200 employs a trip unit 650 with a single actuator for performing tripping, retaining and releasing operations, such as described herein.

For example, the circuit breaker 600 can include a cover and base (together referred to as cover 208) having compartments and recesses for retaining components of the breaker. The components of the circuit breaker 200 can include a movable handle 210 connected to a conductive blade 220 carrying a movable electrical contact 222, a first terminal 202 connected to a stationary electrical contact 232, a second terminal 204 electrically connected to the blade 220 via conductor(s) (not shown), and a controller 290. The first terminal 202 can be a line terminal connected to a power line, and the second terminal 204 can be a load terminal connected to a protected load on a branch circuit.

The circuit breaker 200 can further include a trip unit 650 which, when tripped, causes the blade 220 to move from the closed position to the tripped position, in the event of an overcurrent condition. When the circuit breaker 600 is in the tripped position, the electrical contacts 222 and 232 are disengaged from each other. The trip unit 650 of the circuit breaker 600 can include a trip lever 230, a toggle spring 232, an armature 262, a yoke 264, a reset spring 266 and a magnetic flux transfer system including a single actuator 670 (e.g., a trip and release actuator) implementing tripping, retaining, and releasing operations using electromagnetic force(s) from a solenoid with a ferromagnetic core and a magnetic force(s) from a permanent magnet(s).

Figure 7:
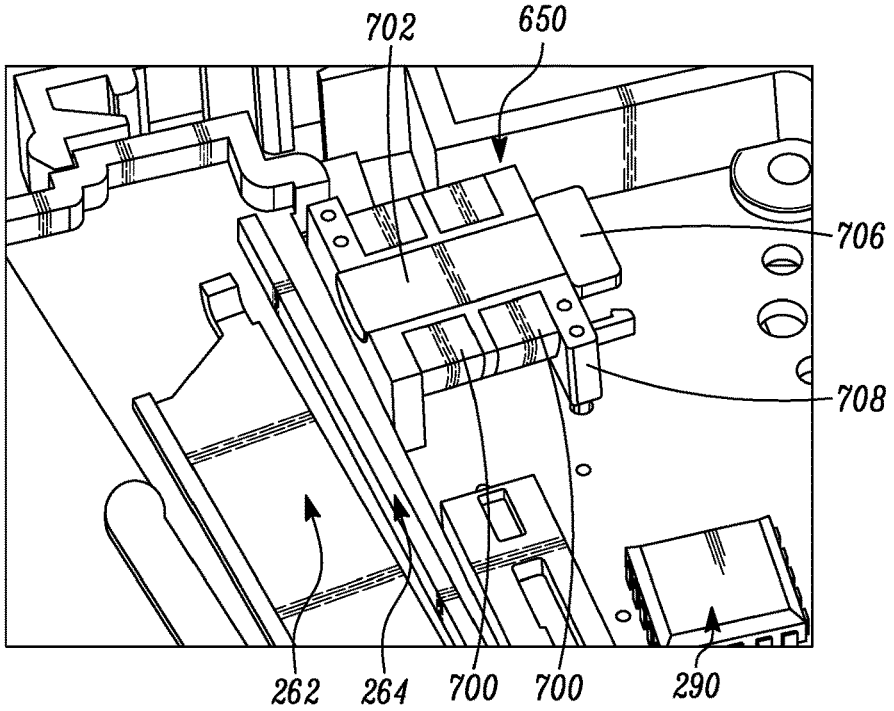
FIG. 7 illustrates a cross-sectional view of the trip and reset actuator of the trip unit of the circuit breaker in FIG. 6 in accordance with an embodiment of the present disclosure.
Figure 8A:
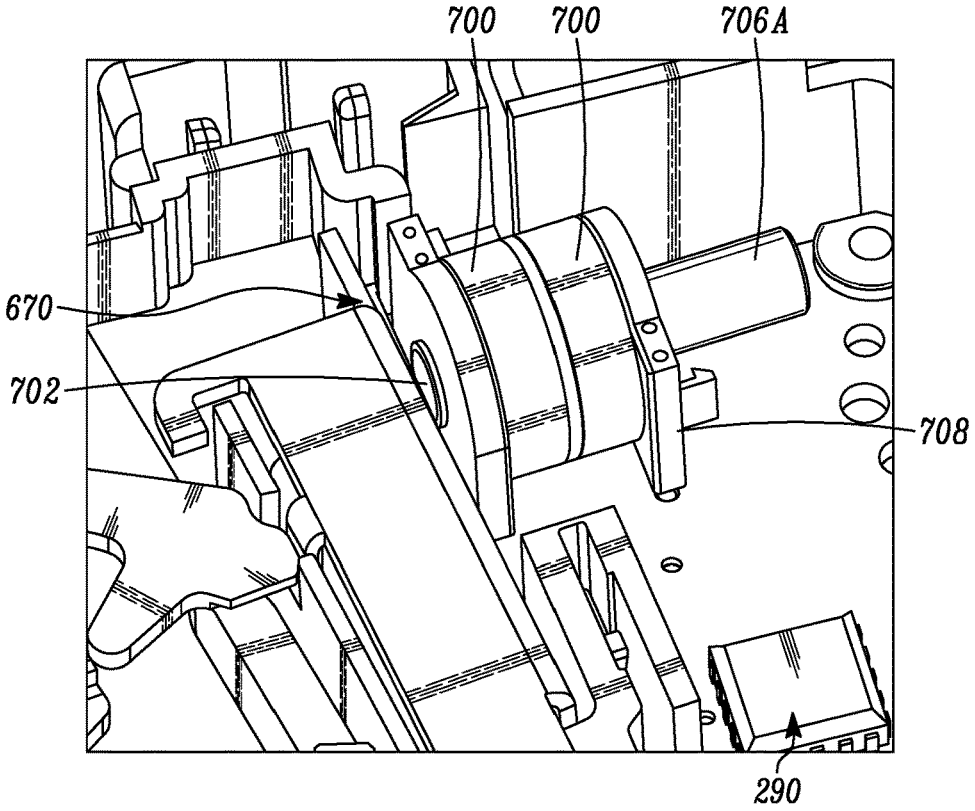
FIG. 8A illustrates an enlarged view of a trip and reset actuator of a trip unit of the circuit breaker of FIG. 6 with a different permanent magnet configuration in accordance with an embodiment of the present disclosure.
Figure 8B:
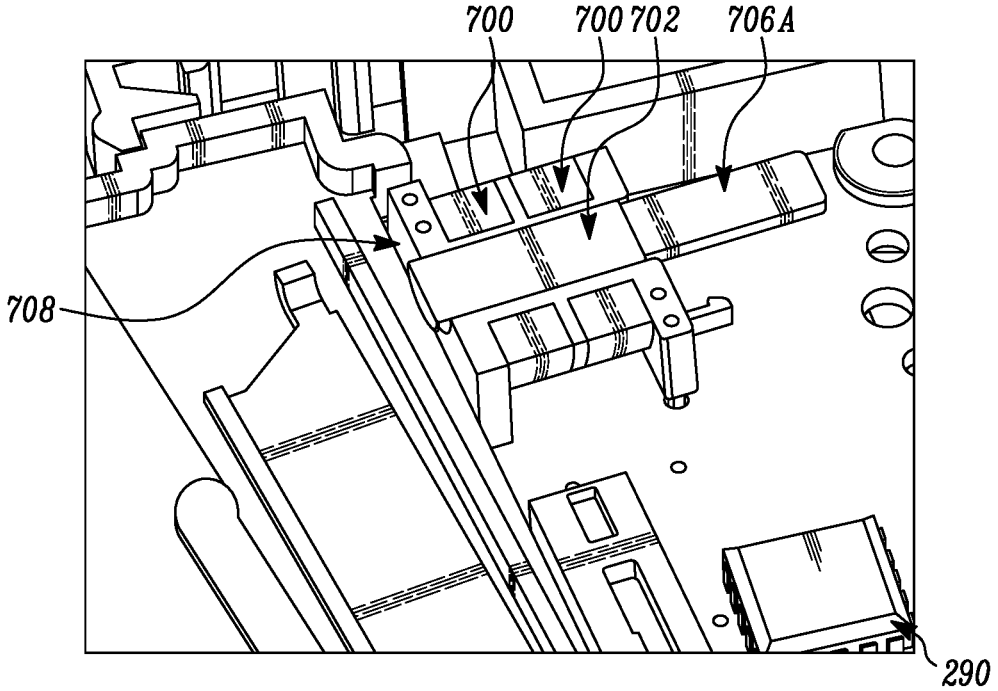
FIG. 8B illustrates a cross-sectional view of the trip and reset actuator of the trip unit in FIG. 8A in accordance with an embodiment of the present disclosure.

As shown in FIG. 7, the actuator 670 includes a conductive coil(s) 700 around a ferromagnetic core 702 (e.g., cylinder-shaped core), a permanent magnet 706 in contact with the ferromagnetic core 702, and a housing 708 to house and/or support the component of the actuator 670. The housing 708 may be formed of an electrically insulating material (e.g., a dielectric material). In this example, one end of the ferromagnetic core 702 faces the yoke 264, and the other end of the ferromagnetic core 702 is in contact with the permanent magnet 706. In FIG. 7, the permanent magnet 706 has a cylindrical shape, such as a disc-shape. However, the permanent magnet of the actuator(s) herein can have different sizes and shapes. For example, the permanent magnet can have a longer cylindrical-shape as shown by the permanent magnet 706A in the example in FIGS. 8A and 8B.

The actuator 670 can be controlled via the controller 290 to produce either an attractive force or repulsive force by changing a polarity or direction of current flow through the conductive coil(s) 700. Although a single actuator 670 is used, the operations are generally the same as previously described above for the two-actuator example of the trip unit 250 of FIG. 2. In this single actuator example, the actuator 670 is configured to generate an electromagnetic field using the solenoid and ferromagnetic material (e.g. core 702), which can apply an attractive force to the components of the circuit breaker 600, such as the armature 262 and the yoke 264. For example, current can be applied in a first direction or polarity through the coil(s) 700 to produce an attractive force. The attractive force generated by the coil(s) 700 in combination with the attractive force from the magnetic field produced by the permanent magnet 706 (via the core 702) can be used to counter the mechanical force of the reset spring 266 and latch friction force, thereby causing the armature 262 and the yoke 264 to move together toward the actuators 670 into the tripped position. In the tripped position, the trip lever 230 is unlatched from the opening 268 of the armature 262, which results in the separation of the electrical contacts 222 and 232. In the tripped position, the yoke 264 can be retained against the ferromagnetic core 702 of the actuator 670 by the attractive force from the permanent magnet 706 (across the core 702).

The actuator 670 is further configured to generate an electromagnetic field using the solenoid and ferromagnetic material (e.g., core 702), which can apply a repulsive force to the components of the circuit breaker 600, such as the armature 262 and the yoke 264. For example, current can be applied in a second direction or polarity (opposite the first direction or polarity) through the coil(s) 700 to produce the repulsive force. The repulsive force generated by the coil(s) 700 in combination with the biasing force of the reset spring 266 can be used to overcome the attractive force of the permanent magnet 706, thereby causing the armature 262 and the yoke 264 to move or return back to a position which allows the circuit breaker 600 and its components to be reset.

Figure 9:
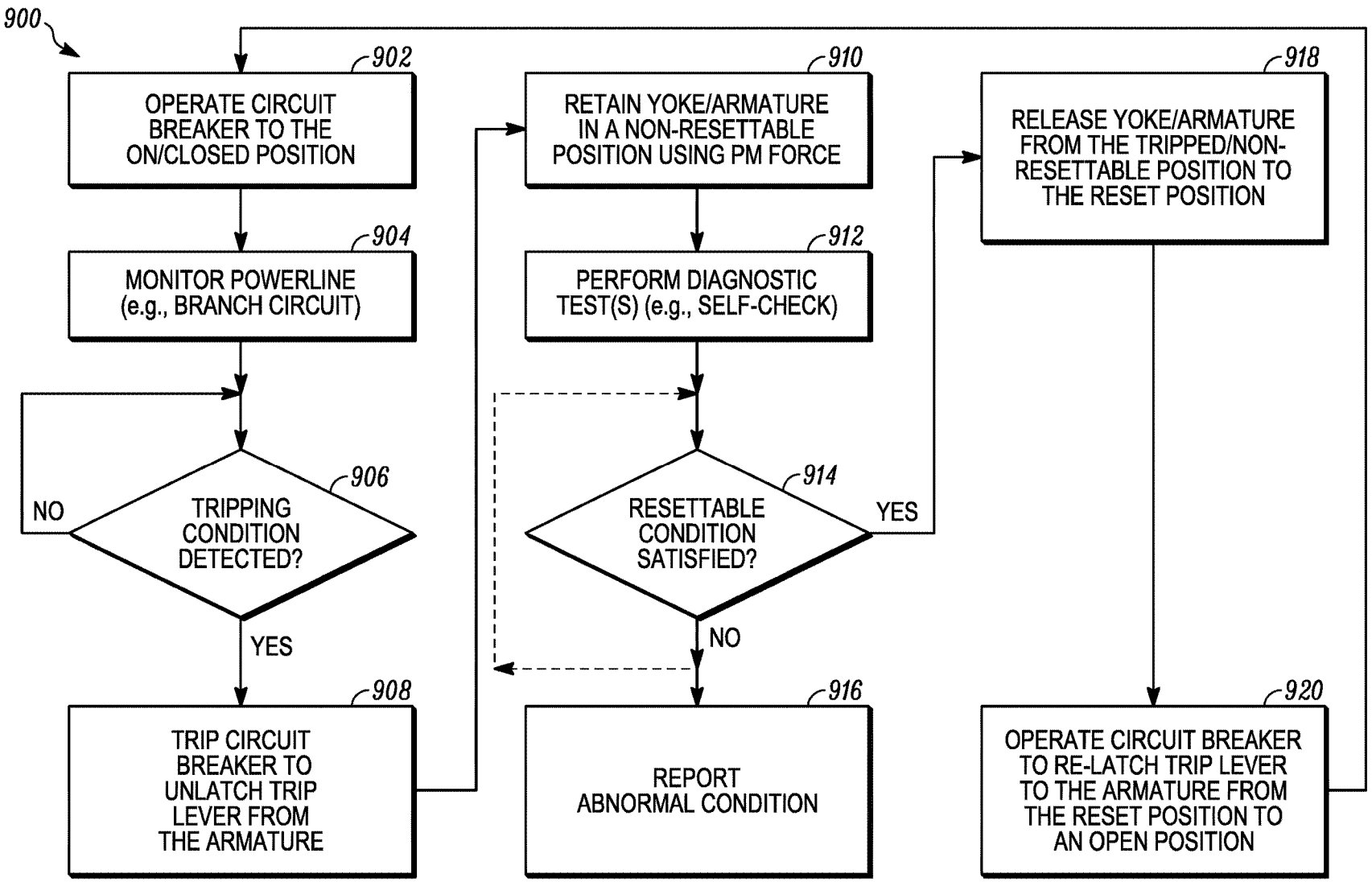
FIG. 9 illustrates a flow diagram of example operations of a circuit breaker in accordance with an embodiment of the present disclosure.

FIG. 9 illustrates a flow diagram of a process 900 implemented by of a circuit breaker, such as described herein, which is used to protect a circuit. For the purpose of explanation, the process 900 will be described with reference to the circuit breaker 100 of FIG. 1, which can include a magnetic flux transfer system with one or more actuators including a solenoid(s) and a permanent magnet(s).

At reference 902, the circuit breaker 100 is operated to a closed or ON position.

At reference 904, the power supply line on the circuit is monitored, such as using one or more sensors (e.g., 180).

At reference 906, a determination is made whether a tripping condition has been detected. This determination can be made at the circuit breaker 100 or remotely via a smart phone app or management service.

At reference 908, if a tripping condition is not detected, then the circuit breaker 100 can continue to monitor conditions on the circuit. Otherwise, if a tripping condition is detected, then the circuit breaker 100 is tripped to a tripped position. For example, the controller of the circuit breaker 100 can cause the trip lever to be unlatched from the armature of the trip unit by controlling one or more actuators, such as described herein.

At reference 910, the components of the trip unit, such as the armature and yoke, are retained in a non-resettable position using the magnetic force from a permanent magnet (s) of actuator(s). For example, as previously shown in FIGS. 5D, 5E and 5F, the yoke is retained against a portion of an actuator by the magnetic force from the permanent magnet. In this tripped position, the trip lever of the trip unit cannot be re-latched to the armature.

At reference 912, the circuit breaker 100 can perform a self-check, diagnostic test(s), or other evaluation related to the operation or components of the circuit breaker or the power system (e.g., normal or abnormal operational state) in order to determine whether the circuit breaker 100 should be returned to a reset (or resettable) position or state.

At reference 914, the circuit breaker 100 can determine whether a resettable condition has been satisfied, such as for example, in light of the self-check, diagnostic test(s) or other evaluation. If the resettable condition has not been satisfied, then the circuit breaker 100 can report an abnormal condition at reference 916. The report can be provided locally at the circuit breaker or to a remote system (e.g., a management system). If the resettable condition has been satisfied, then the circuit breaker 100 can release the components of the trip unit back to a reset (or resettable) position at reference 918. For example, the controller of the circuit breaker 100 can release the armature and yoke from the tripped position using the actuator(s), such as described herein.

At reference 920, the circuit breaker 100 can be operated to an open position from the reset position, e.g., by re-latching the trip lever to the armature. Thereafter, the process 900 can return to reference 902 in which the circuit breaker 100 can be operated to a closed or ON position.

Figure 10:
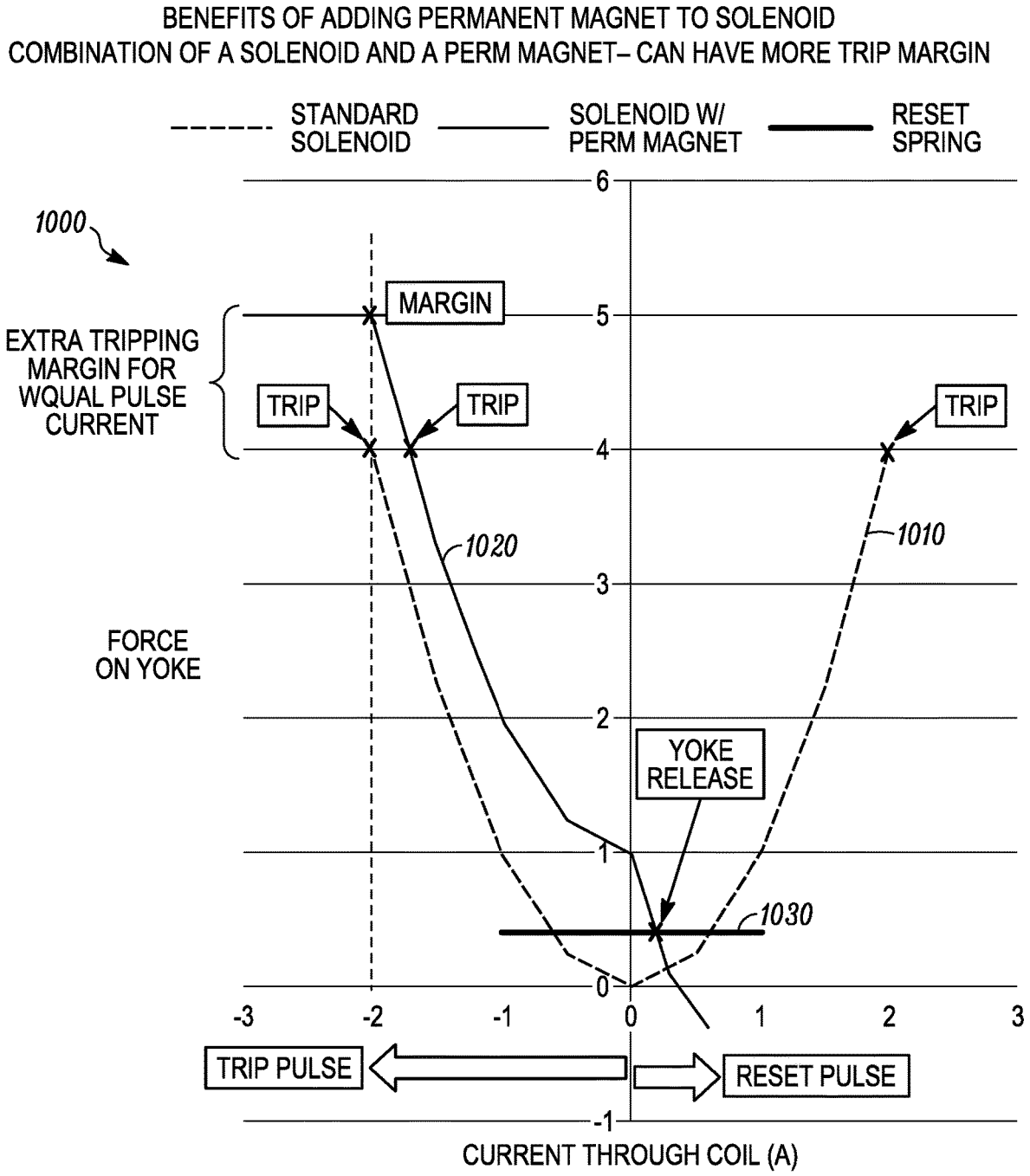
FIG. 10 illustrates example graphs showing the force on the yoke versus the current through a coil for a standard solenoid, a solenoid with permanent magnet and a reset spring.
Figure 11:
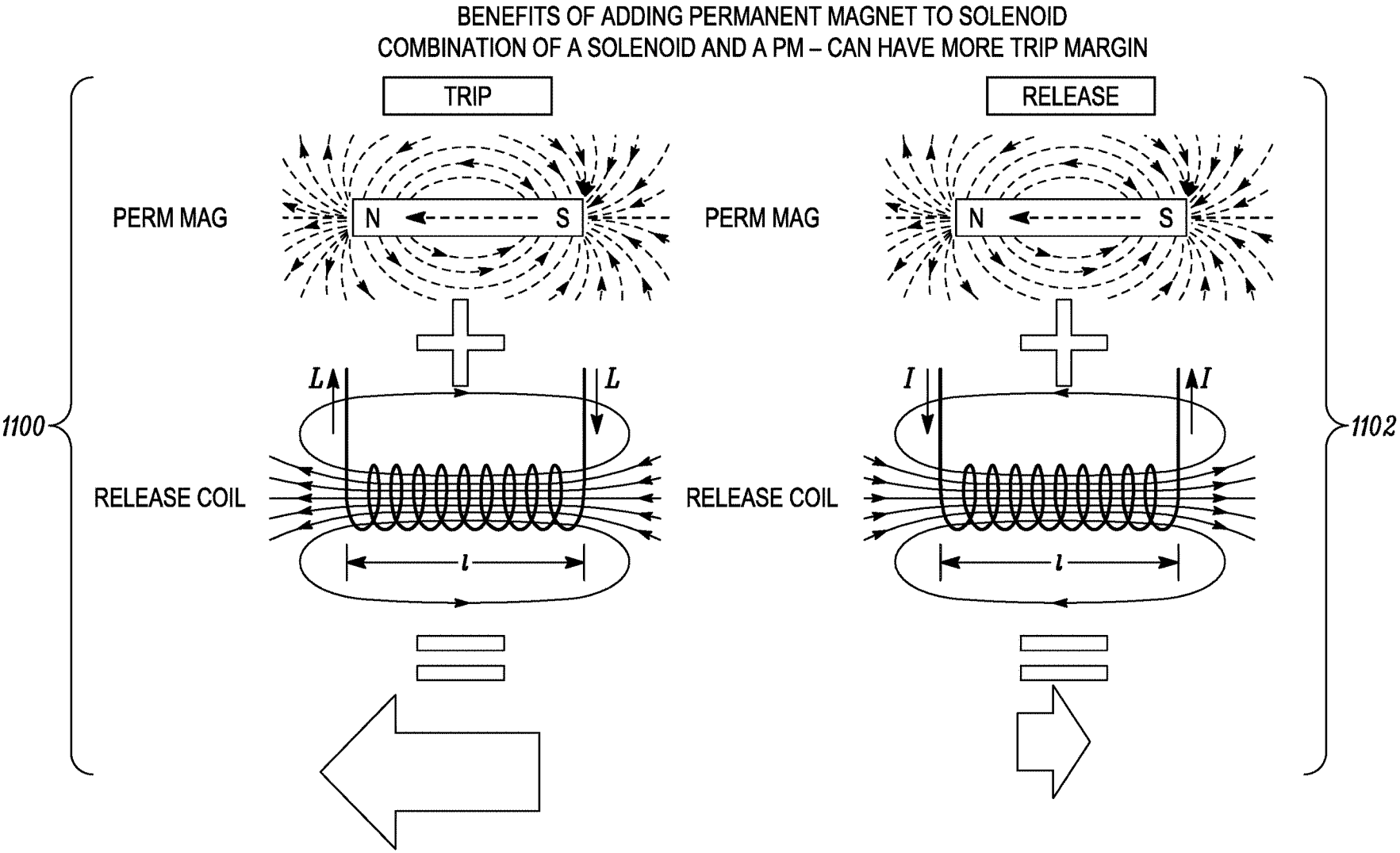
FIG. 11 illustrates examples showing a resultant force for a trip unit with solenoid and permanent magnet configuration when performing trip and release operations in accordance with an embodiment of the present disclosure.

FIG. 10 illustrates example graph 1000 showing force on the yoke versus current (in Amp) through a coil for a standard solenoid configuration (1010) and a solenoid/permanent magnet configuration (1020). The biasing force of the reset spring is also shown (1030). Since the permanent magnet will always be acting on the yoke even with no trip pulse (e.g., zero (0) current), the solenoid/permanent magnet configuration can have a trip force advantage over the entire range of trip pulse versus a standard solenoid configuration. Thus, at the point of tripping, the solenoid/permanent magnet configuration can require less current. In other words, for the same trip current of the standard solenoid configuration, the solenoid/permanent magnet configuration has more trip force margin. This trip force margin is further shown in the trip and release force diagrams 1100 and 1102, respectively, in FIG. 11, when performing trip and release operations, respectively.

In the preceding, reference is made to various embodiments. However, the scope of the present disclosure is not limited to the specific described embodiments. Instead, any combination of the described features and elements, whether related to different embodiments or not, is contemplated to implement and practice contemplated embodiments. Furthermore, although embodiments may achieve advantages over other possible solutions or over the prior art, whether or not a particular advantage is achieved by a given embodiment is not limiting of the scope of the present disclosure. Thus, the preceding aspects, features, embodiments and advantages are merely illustrative and are not considered elements or limitations of the appended claims except where explicitly recited in a claim(s).

The various embodiments disclosed herein may be implemented as a system, method or computer program product. Accordingly, aspects may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects may take the form of a computer program product embodied in one or more computer-readable medium(s) having computer-readable program code embodied thereon.

Any combination of one or more computer-readable medium(s) may be utilized. The computer-readable medium may be a non-transitory computer-readable medium. A non-transitory computer-readable medium may be, for example, but not limited to, an electronic, magnetic, optical, electromagnetic, infrared, or semiconductor system, apparatus, or device, or any suitable combination of the foregoing. More specific examples (a non-exhaustive list) of the non-transitory computer-readable medium can include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. Program code embodied on a computer-readable medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages. Moreover, such computer program code can execute using a single computer system or by multiple computer systems communicating with one another (e.g., using a local area network (LAN), wide area network (WAN), the Internet, etc.). While various features in the preceding are described with reference to flowchart illustrations and/or block diagrams, a person of ordinary skill in the art will understand that each block of the flowchart illustrations and/or block diagrams, as well as combinations of blocks in the flowchart illustrations and/or block diagrams, can be implemented by computer logic (e.g., computer program instructions, hardware logic, a combination of the two, etc.). Generally, computer program instructions may be provided to a processor(s) of a general-purpose computer, special-purpose computer, or other programmable data processing apparatus. Moreover, the execution of such computer program instructions using the processor(s) produces a machine that can carry out a function(s) or act(s) specified in the flowchart and/or block diagram block or blocks.

A processor(s) or controller(s) as described herein can be a processing system, which can include one or more processors, such as CPU, GPU, controller, FPGA (Field Programmable Gate Array), ASIC (Application-Specific Integrated Circuit) or other dedicated circuitry or other processing unit, which controls the operations of the devices or systems, described herein. Memory/storage devices can include, but are not limited to, disks, solid state drives, optical disks, removable memory devices such as smart cards, SIMs, WIMs, semiconductor memories such as RAM, ROM, PROMS, etc.

This disclosure is not limited in its application to the details of construction and the arrangement of components set forth in the following descriptions or illustrated by the drawings. The disclosure is capable of other embodiments and of being practiced or of being carried out in various ways. Also, the phraseology and terminology used herein is for description purposes and should not be regarded as limiting. The use of "including," "comprising," "having," "containing," "involving," and variations herein, are meant to be open-ended, i.e. "including but not limited to."

The flowchart and block diagrams in the Figures illustrate the architecture, functionality and/or operation of possible implementations of various embodiments of the present disclosure. In this regard, each block in the flowchart or block diagrams may represent a module, segment or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It is to be understood that the above description is intended to be illustrative, and not restrictive. Many other implementation examples are apparent upon reading and understanding the above description. Although the disclosure describes specific examples, it is recognized that the systems and methods of the disclosure are not limited to the examples described herein, but may be practiced with modifications within the scope of the appended claims. Accordingly, the specification and drawings are to be regarded in an illustrative sense rather than a restrictive sense. The scope of the disclosure should, therefore, be determined with reference to the appended claims, along with the full scope of equivalents to which such claims are entitled.

We claim:

1. A trip unit for a circuit protective device, the trip unit comprising:

a movable armature having a front side, a back side and an opening extending from the front side to the back side, the opening configured to receive a portion of a trip lever of the circuit protective device from the front side when in an ON position;

a movable yoke arranged adjacent to the back side of the armature, the yoke and armature being configured to move together to different positions including a reset position and a tripped position, the reset position being a position in which the portion of the trip lever is resettable into the opening of the armature, the tripped position being a position in which the trip lever is released from the opening of the armature and is unable to be reset into the opening of the armature;

a reset spring to apply a force that biases the armature toward the reset position; and a magnetic flux transfer system including a permanent magnet and one or more solenoids each with a ferromagnetic core, the magnetic flux transfer system being configured:

to generate an attractive force using a solenoid from the one or more solenoids to counter the force of the reset spring and latch friction force when a tripping condition is detected, the generated attractive force together with an attractive force from the permanent magnet attracting the yoke which in turn moves the yoke together with the armature to the tripped position, to retain the yoke and armature in the tripped position using the attractive force of the permanent magnet when the generated attractive force is no longer being generated, and to generate a repulsive force using a solenoid from the one or more solenoids when a resettable condition is satisfied, the generated repulsive force together with the force of the reset spring countering the attractive force of the permanent magnet thereby releasing the yoke and armature from the tripped position and allowing the yoke and armature to move to the reset position.

2. The trip unit according to claim 1, wherein a solenoid from the one or more solenoids is configured to produce the attractive and repulsive forces by changing a polarity of current supplied thereto under different conditions including the tripping condition and the resettable condition.

3. The trip unit according to claim 2, wherein the ferromagnetic core of the solenoid includes a first end which faces a direction of the yoke and a second end which is in contact with or proximity to the permanent magnet.

4. The trip unit according to claim 3, wherein, in the tripped position, the yoke is in contact with the first end of the ferromagnetic core.

5. The trip unit according to claim 1, further comprising a trip actuator and a reset actuator, the trip actuator including a first solenoid from the one more solenoids, the reset actuator including a second solenoid from the one or more solenoids and the permanent magnet which is in contact with a ferromagnetic core of the second solenoid.

6. The trip unit according to claim 5, wherein the first solenoid is energized to generate an attractive force, and the second solenoid is energized to generate a repulsive force.

7. The trip unit according to claim 1, wherein the circuit protective device comprises a miniature circuit breaker.

8. A circuit protective device comprising:

a trip unit according to one of claim 1;

the trip lever;

a stationary electrical contact;

a blade carrying a movable electrical contact configured to move between a first position and a second position, the first position being a position in which the movable electrical contact is in contact with the stationary electrical contact to allow current to flow thereacross in an ON position, the second position being a position in which the movable electrical contact is separated from the stationary electrical contact in one of a tripped position, open position or reset position;

a memory;

one or more processors configured:

to control the trip unit to operate to the tripped position when the tripped condition is detected thereby causing the blade to move to the second position, and to operate to the reset position from the tripped position when the resettable condition is satisfied, wherein, in the tripped position, the trip lever is released from the opening of the armature which in turn causes the movable electrical contact to separate from the stationary electrical contact, wherein, in the reset position, the trip lever is operable to an open position, which latches the portion of the trip lever into the opening.

9. A method of performing a tripping operation on a circuit protective device with a trip unit including a permanent magnet, one or more solenoids each with a ferromagnetic core, a trip lever, a reset spring, and a yoke and armature which are configured to move to different positions including a reset position and a tripped position, the reset position being a position in which the portion of the trip lever is resettable into the opening of the armature, the tripped position being a position in which the trip lever is released from the opening of the armature and is unable to be reset into the opening of the armature, the method comprising:

generating an attractive force using a solenoid from the one or more solenoids to counter the force of the reset spring and latch friction force when a tripping condition is detected, the generated attractive force together with an attractive force from the permanent magnet attracting the yoke which in turn moves the yoke together with the armature to the tripped position;

retaining the yoke and armature in the tripped position using the attractive force of the permanent magnet when the generated attractive force is no longer being generated, and generating a repulsive force using a solenoid from the one or more solenoids when a resettable condition is satisfied, the generated repulsive force together with the force of the reset spring countering the attractive force of the permanent magnet thereby releasing the yoke and armature from the tripped position and allowing the yoke and armature to move to the reset position.

10. The method according to claim 9, wherein a solenoid from the one or more solenoids is configured to produce the attractive and repulsive forces by changing a polarity of current supplied thereto under different conditions including the tripping condition and the resettable condition.

11. The method according to claim 10, wherein the ferromagnetic core of the solenoid includes a first end which faces a direction of the yolk and a second end which is in contact with or proximity to the permanent magnet.

12. The method according to claim 11, wherein, in the tripped position, the yoke is in contact with the first end of the ferromagnetic core.

13. The method according to claim 9, wherein the trip unit includes a trip actuator and a reset actuator, the trip actuator including a first solenoid from the one more solenoids, the reset actuator including a second solenoid from the one or more solenoids and the permanent magnet which is in contact with a ferromagnetic core of the second solenoid.

14. The method according to claim 13, wherein the first solenoid is energized to generate an attractive force, and the second solenoid is energized to generate a repulsive force.

15. The method according to claim 9, wherein the circuit protective device comprises a miniature circuit breaker.

16. A trip unit for a circuit protective device, the trip unit comprising:

an armature and yoke movable together between different positions including a reset position and a tripped position, the tripped position being a position in which a trip lever is released from an opening of the armature, the reset position being a position in which the trip lever is resettable into the opening of the armature;

a reset spring to apply a force that biases the armature toward the reset position; and a magnetic flux transfer system including a permanent magnet and one or more solenoids each with a ferromagnetic core, the magnetic flux transfer system being configured to:

generate an attractive or repulsive force using the one or more solenoids to control movement of the armature and yoke between the different positions, and retain the yoke and armature in the tripped position using the attractive force of the permanent magnet when the yoke and armature are moved to the tripped position.

* * * * *